US010814650B2

(12) United States Patent
Okuda et al.

(10) Patent No.: US 10,814,650 B2
(45) Date of Patent: Oct. 27, 2020

(54) INK JET RECORDING METHOD

(71) Applicant: Seiko Epson Corporation, Tokyo (JP)

(72) Inventors: Ippei Okuda, Shiojiri (JP); Akiko Matsuzaki, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 16/362,801

(22) Filed: Mar. 25, 2019

(65) Prior Publication Data

US 2019/0291473 A1 Sep. 26, 2019

(30) Foreign Application Priority Data

Mar. 26, 2018 (JP) ..... 2018-058817

(51) Int. Cl.
*B41J 11/00* (2006.01)
*B41M 5/00* (2006.01)

(52) U.S. Cl.
CPC ..... *B41J 11/002* (2013.01); *B41M 5/0023* (2013.01)

(58) Field of Classification Search
CPC .. B41J 11/0015; B41J 11/002; B41M 5/0023; B41M 5/0017; B41M 5/0011; C09D 11/326; C09D 11/106; C09D 11/322; C09D 11/38
USPC ..... 347/95, 100, 102; 106/31.13, 31.6, 31.9
See application file for complete search history.

(56) References Cited

U.S. PATENT DOCUMENTS 8,697,773 B2 * 4/2014 Okuda ..... C09D 11/10 347/1
2008/0131614 A1 6/2008 Oriakhi
2012/0236070 A1 9/2012 Okuda et al.
2013/0224451 A1 8/2013 Shiono et al.
2017/0051169 A1 2/2017 Kasperchik et al.
2017/0355867 A1 12/2017 Kasperchik et al.
2018/0002555 A1 1/2018 Kasperchik et al.
2018/0010006 A1 1/2018 Kasperchik et al.
2018/0100078 A1 4/2018 Kasperchik et al.
2019/0292392 A1 * 9/2019 Okuda ..... C09D 11/107

FOREIGN PATENT DOCUMENTS

JP 2010-511747 A 4/2010
JP 2013-181055 A 9/2013
JP 2015-232141 A 12/2015
(Continued)

*Primary Examiner* — An H Do
(74) *Attorney, Agent, or Firm* — Harness, Dickey & Pierce, P.L.C.

(57) ABSTRACT

An ink jet recording method includes: heating a recording medium; and ejecting a white color water-based ink composition from an ink jet head to a recording medium heated in the heating of the recording medium and causing the white color water-based ink composition to adhere to the recording medium, the causing of the white color water-based ink composition to adhere is performed by performing scanning, in which the ink composition is ejected while relative positions between the ink jet head and the recording medium are changed in a scanning direction, a plurality of times, and a maximum time of the scanning performed once is equal to or greater than 0.8 seconds, and the white color water-based ink composition contains first particles that are a white color pigment and second particles that are particles of a different kind from the first particles and that are inorganic fine particles.

12 Claims, 2 Drawing Sheets

(56) References Cited

FOREIGN PATENT DOCUMENTS

| | | | |
|---|---|---|---|
| WO | WO-2016-175743 | A1 | 11/2016 |
| WO | WO-2016-175871 | A1 | 11/2016 |
| WO | WO-2017-014745 | A1 | 1/2017 |

* cited by examiner

INK JET RECORDING METHOD

BACKGROUND

1. Technical Field

The present invention relates to an ink jet recording method.

2. Related Art

An ink jet recording method is a method of performing recording by ejecting small ink droplets from fine nozzles and causing the small ink droplets to adhere to a recording medium. This method has a characteristic that it is possible to record an image with high resolution and high quality at a high speed with a relatively inexpensive apparatus.

In recent years, direct recording (printing) of a product label or the like by the ink jet recording method on a recording medium such as a film has been examined. It is desirable to use a water-based ink for the aforementioned printing since high safety is required for such a purpose. In a case in which a water-based ink is used, a heating and drying processing may further be performed after the printing.

Since a recorded surface of the film is made of a plastic material such as polyolefin, nylon, or polyester, for example, the recorded surface is transparent or semitransparent in many cases. Therefore, a predetermined image may be formed with color ink on a layer formed with white-based ink that is called an underlayer that hides a background when ink jet recording is performed (see JP-A-2015-232141, for example).

A problem that clogging of white ink, in particular, tends to occur when recording is performed on a recording medium with a wide width. This is estimated to be because a time of scanning performed once is long and drying of the ink in the nozzles tends to advance.

In a case in which a processing solution that includes an aggregating agent for aggregating constituents of a white color water-based ink composition is used, a problem of cracking may occur although it is possible to improve color image quality.

SUMMARY

An advantage of some aspects of the invention is to provide an ink jet recording method (first invention) capable of improving clogging resistance while maintaining image quality and whiteness of an image recorded with a white color ink even in a case in which a time of scanning performed once is long in an ink jet recording method using the white color ink.

An advantage of other aspects of the invention is to provide an ink jet recording method (second invention) capable of improving cracking resistance and whiteness in an ink jet recording method using a processing solution and a white color ink.

The inventors have conducted intensive studies to solve the aforementioned problems. As a result, the inventors have discovered that it is possible to perform recording such that excellent image quality, whiteness, and clogging resistance of an image recorded with a white color ink are achieved by adding inorganic fine particles to the white ink that includes a white color pigment (first invention).

The inventors have discovered that it is possible to record an image with excellent whiteness and less cracking by adding inorganic fine particles to white ink that includes a white color pigment (second invention).

The invention is as follows.

[1] According to an aspect of the invention, there is provided an ink jet recording method including: heating a recording medium; and ejecting a white color water-based ink composition from an ink jet head to a recording medium heated in the heating of the recording medium and causing the white color water-based ink composition to adhere to the recording medium, the causing of the white color water-based ink composition to adhere is performed by performing scanning, in which the ink composition is ejected while relative positions between the ink jet head and the recording medium are changed in a scanning direction, a plurality of times, and a maximum time of the scanning performed once is equal to or greater than 0.8 seconds, and the white color water-based ink composition contains first particles that are a white color pigment and second particles that are particles of a different kind from the first particles and that are inorganic fine particles.

[2] The ink jet recording method may further include: causing a processing solution that includes an aggregating agent for aggregating constituents of the white color water-based ink composition to adhere to the recording medium.

[3] In the ink jet recording method, a volume average particle diameter of the first particles may be equal to or greater than 150 nm, and a volume average particle diameter of the second particles may be equal to or less than 100 nm.

[4] In the ink jet recording method, the first particles may be the white color pigment made of an inorganic oxide, and the second particles may be particles of an inorganic oxide.

[5] In the ink jet recording method, 7 to 15% by mass of the first particles may be included in the white color water-based ink composition.

[6] In the ink jet recording method, the white color water-based ink composition may include 1 to 20 parts by mass of the second particles with respect to 100 parts by mass of the first particles.

[7] In the ink jet recording method, a surface temperature of the recording medium during the causing of the white color water-based ink composition to adhere may be from 30 to 45° C.

[8] In the ink jet recording method, an increase rate of viscosity after mixing the white color water-based ink composition with the processing solution may be equal to or less than 2.5 times.

[9] In the ink jet recording method, a width of the recording medium in the scanning direction may be equal to or greater than 50 cm.

[10] In the ink jet recording method, an adhesion region in which an amount of the adhering processing solution is 5 to 20% by mass with respect to an amount of the adhering white color water-based ink composition may be included.

[11] In the ink jet recording method, the aggregating agent included in the processing solution may be one or more kinds of polyvalent metal salts, cationic polymers, and organic acids.

[12] In the ink jet recording method, transmittance of the second particles may be higher than transmittance of the first particles.

According to another aspect of the invention, there is provided an ink jet recording method including: causing a processing solution that includes an aggregating agent for aggregating constituents of a white color water-based ink composition to adhere to a recording medium; and ejecting the white color water-based ink composition from an ink jet head to the recording medium and causing the white color water-based ink composition to adhere to the recording medium, in which the white color water-based ink composition contains first particles that are a white color pigment and second particles that are inorganic fine particles of a different kind from the first particles.

Further, the ink jet recording method according to another aspect may include any one or more of [1] to [12].

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
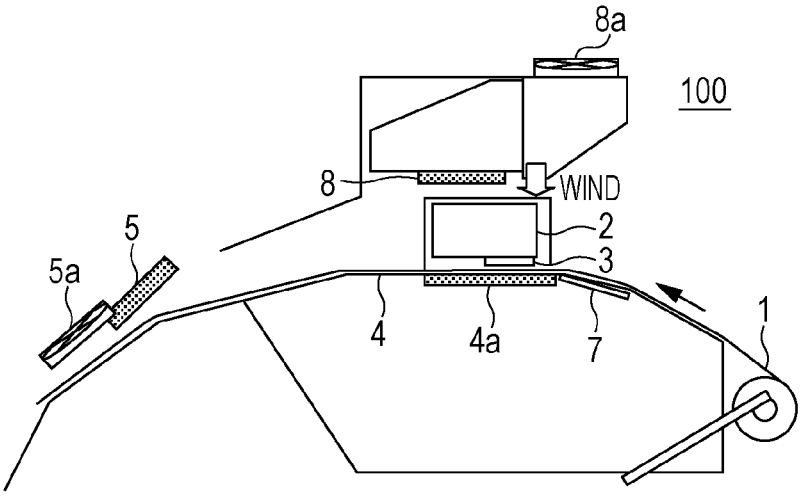
FIG. 1 is a schematic view of an ink jet apparatus that is used in an ink jet recording method according to an embodiment.

Hereinafter, although an embodiment of the invention (hereinafter, referred to as "the embodiment") will be described later with reference to drawings as needed, the invention is not limited thereto, and various modifications can be made without departing from the gist thereof. Note that the same reference numerals will be provided to the same elements in the drawings and repeated description will be omitted. In addition, positional relationships, such as an upper side, a lower side, a left side, or a right side, are on the basis of the positional relationships illustrated in the drawings unless otherwise particularly indicated. Further, dimensional ratios in the drawings are not limited to the ratios illustrated in the drawings.

An ink jet recording method according to an embodiment of the first invention includes a heating process of heating a recording medium and an ink adhesion process of ejecting a white color water-based ink composition (hereinafter, simply referred to as a white color ink composition) from an ink jet head to the recording medium heated in the heating process and causing the white color water-based ink composition to adhere to the recording medium. In a case in which the ink adhesion process is performed by performing scanning, in which an ink composition is ejected while relative positions of the ink jet head and the recording medium are changed in a scanning direction, a plurality of times, the maximum time of the scanning performed once is equal to or greater than 0.8 seconds, the white color water-based ink composition that contains first particles that is a white color pigment and second particles that are inorganic fine particles of a different kind from the first particles is used.

The inventors have achieved to the employment of the ink jet recording method with the aforementioned configuration as a result of intensive studies in order to achieve such recording that excellent image quality (shielding properties and whiteness) that is necessary for the white color ink composition and excellent clogging resistance. Although a countermeasure of performing flashing from all the nozzles every time scanning is performed thereby also causing unused nozzles during the scanning to eject ink for cleaning or a countermeasure of reducing drying of the ink at the nozzles by minimizing the heating temperature in order to prevent nozzle clogging of the white color ink composition are considered, it is considered that in a case in which the width of the recording medium is wide, a time of scanning performed once is long, drying at unused nozzles advances during the scanning performed once depending on design of an image, and recovery cannot be achieved through the flashing. The white color ink composition tends to significantly cause clogging in a case in which the heating recording process is used, and in particular, in a case in which the ink at the nozzles is heated and the drying advances. This is estimated to be because viscosity tends to increase when the ink is dried at the nozzles and the solid content increases, and it becomes difficult to eject the ink from the nozzles. This is estimated to be because a large amount of white color pigment is added in many cases in order to achieve whiteness and shielding properties and thus tends to be dried and cause clogging at the nozzles. Thus, it is possible to perform such recording that excellent image quality (white image quality and whiteness) that is necessary for the white ink and excellent clogging resistance are achieved on a recording medium with a wide width by adding inorganic fine particles to the white color ink composition that includes the white color pigment, and it is possible to create a recorded product that is useful for signage or the like. Hereinafter, constituents of the white color ink composition will be described.

White Color Ink Composition

In the ink jet recording method according to the embodiment, a white color water-based ink composition (hereinafter, simply referred to as a white color ink composition) that contains first particles that are a white color pigment and second particles that are inorganic fine particles of a different kind of the first particles is used. The water based composition is a composition that contains water as one of main solvent constituents, and the content of water in the composition is preferably equal to or greater than 40% by mass.

Note that in a case in which the first particles and the second particles are simply referred, this is just intended to distinguish the particles and does not mean that constituents and properties thereof are limited.

The white color ink composition is ink with which it is possible to record a color that is generally called "white" from common sense and includes ink that has slightly been colored. Also, the white color ink composition includes ink that is called and sold with a name such as "white (color) ink or white ink" or the like. Alternatively, the white color ink composition includes ink with brightness (L*) and color levels (a*, b*) of a recorded product that satisfy the ranges $60 \le L^* \le 100$, $-4.5 \le a^* \le 2$, and $-10 \le b^* \le 2.5$ in a case in which recording is performed with such an amount of ink that a surface of a recording medium made of a transparent film is sufficiently covered, for example, and in a case in which color measurement for the brightness (L*) and the color levels (a*, b*) is performed using a spectrophotometric device in accordance with CIELAB. Examples of the recording medium made of a transparent film include LAG jet E-1000ZC (manufactured by Lintec Corporation). Examples of a spectrophotometric device in accordance with CIELAB include a Spectrolino (name of product manufactured by GretagMacbeth), and examples of measurement include measurement under settings in which a measurement condition is set to a D50 light source, an observation field of view is set to 2°, concentration is set to DIN NB, a white color reference is set to Abs, a filter is set to No, and a measurement mode is set to Reflectance.

First Particles

The first particles are a white color pigment. The white color pigment is a pigment that is included in the white color ink composition and forms ink as a white color ink composition by being included in the ink. Alternatively, such a pigment that a color measurement value obtained when a pigment water dispersion that contains 10% by mass of the pigment in terms of solid content is caused to adhere to a recording medium similarly to the aforementioned white color ink composition and the color thereof is similarly measured satisfies that of the white color ink composition may be regarded as the white color pigment.

The volume average particle diameter of the white color pigment is preferably equal to or greater than 150 nm, is more preferably equal to or greater than 200 nm, and is further preferably equal to or greater than 250 nm. Also, the volume average particle diameter of the white color pigment is preferably equal to or less than 400 nm and is more preferably equal to or less than 350 nm. In this manner, white color ink with excellent shielding properties and whiteness is obtained.

The volume average particle diameter of the white color pigment can be measured using a D50 value by a grain size distribution measurement apparatus that uses a laser diffraction scattering method as a measurement principle. Examples of the grain size distribution measurement apparatus include a grain size distribution meter (for example, "Microtrac UPA" manufactured by Nikkiso Co., Ltd.) that uses a dynamic light scattering method as a measurement principle. The measurement may be performed using a water dispersion of the white color pigment.

Although a material of the white color pigment is not particularly limited, preferable examples of the material to be used include inorganic oxides such as titanium oxide, zinc oxide, zinc sulfide, antimony oxide, magnesium oxide, and zirconium oxide. Also, a pigment formed of a metal compound other than the inorganic oxide, a pigment formed of a half-metal compound, or a pigment formed of resin may be used.

In the white color ink composition, 5 to 20% by mass of the white color pigment is preferably included, 7 to 15% by mass of the white color pigment is more preferably included, 8 to 13% by mass of the white color pigment is further preferably included, and 9 to 12% by mass of the white color pigment is further preferably included.

Second Particles

The second particles are particles of a different kind from the first particles. The different kind means a different size or a different material of particles. The different particle size means that the aforementioned volume average particle diameter is different. The different material means that materials of the particles are different. For example, this refers to a relationship such as magnesium oxide and zirconium oxide.

In a case in which the size of the second particles is different from the size of the first particles, the volume average particle diameter of the first particles is preferably greater than that of the second particles, is more preferably greater than that in the second particles by 70 nm or greater, is more preferably greater than that in the second particles by 100 nm or greater, is further preferably greater than that in the second particles by 150 nm, and is particularly preferably greater than that in the second particles by 200 nm or greater. Although the embodiment is not limited thereto, the volume average particle diameter of the first particles is preferably greater than that of the second particles by 300 nm or less.

It is preferable that the material of the second particles be different from that of the first particles, and it is more preferable that both the materials and the particle sizes are different.

The second particles are inorganic fine particles. The inorganic fine particles may correspond to the aforementioned white color pigments or may be pigments other than the white color pigments. Although the material thereof is not particularly limited, the material may be the inorganic fine particles that are the aforementioned materials of the white color pigment or may be inorganic fine particles other than the materials. Preferable examples of the inorganic fine particles to be used include silica such as colloidal silica and inorganic oxides such as titanium oxide, zinc oxide, zinc sulfide, antimony oxide, magnesium oxide, aluminum oxide, and zirconium oxide. Among the examples, aluminum oxide, silica, and zirconium oxide are further preferably used, and silica is more preferably used.

These cases are preferable since it is possible to achieve higher transmittance and to achieve further prevention of degradation of clogging resistance due to the first particles by the second particles entering gaps of the first particles.

The inorganic fine particles other than the white color pigment are such inorganic fine particles that a measurement value that is obtained when a water dispersion that contains 10% by mass of the inorganic fine particles in terms of solid content is caused to adhere to the recording medium similarly to the aforementioned white color ink composition and the color is similarly measured does not satisfy the value for the white color ink composition.

In any cases, the measurement value of the second particles obtained when a water dispersion that contains 10% by mass of the inorganic fine particles in terms of solid content is caused to adhere to the recording medium similarly to the aforementioned white color ink composition and the color is similarly measured preferably satisfies ranges of $-4.5 \leq a^* \leq 2$ and $-10 \leq b^* \leq 2.5$. Since the second particles are used in the white color ink composition, the second particles are preferably particles of an achromatic color. A color with the measurement value that satisfies the ranges of $-4.5 \leq a^* \leq 2$ and $-10 \leq b^* \leq 2.5$ is regarded as the achromatic color.

Further, the second particles preferably have higher transmittance than that of the first particles as will be described later. That is, the second particles are preferably colorless and transparent or are closer to colorless and transparent.

The volume average particle diameter of the second particles is preferably smaller than that of the first particles, is preferably equal to or less than 100 nm, is more preferably equal to or less than 95 nm, and is further preferably equal to or less than 90 nm. In this manner, it is possible to improve clogging resistance of the white color ink composition. Although the lower limit thereof is not limited, the lower limit is preferably equal to or greater than 10 nm, is more preferably equal to or greater than 30 nm, and is further preferably equal to or greater than 50 nm. The lower limit that falls within the aforementioned range is preferable in terms of higher transmittance of the second particles, which will be described later, and more excellent clogging resistance. The volume average particle diameter of the second particles is measured by the same method as that of the volume average particle diameter of the first particles.

The transmittance of the second particles is preferably higher than that of the first particles. Transmittance obtained when water dispersions of 2% by mass of the respective particles are prepared and the transmittance in a visible light wavelength range is measured is regarded as the transmitted described here. Specifically, average transmittance in a wavelength range of 380 to 480 nm can be regarded as the transmittance described here. It is possible to improve clogging resistance while maintaining image quality (shielding properties and whiteness) that is necessary for the white ink by using such inorganic fine particles along with the white color pigment.

It is possible to improve clogging resistance of the white color ink composition by the ink including the second particles that are such inorganic fine particles. The reason of the excellent clogging resistance is estimated as follows. Although the nozzles are affected by head in the ink adhesion process, drying of the ink at the nozzles advances, the white color pigment is solidified, and this leads to non-satisfactory ejection, it is estimated to be possible to prevent the first particles from being solidified due to the second particles entering the gaps of the first particles since the second particles are present, and thereby to recover the ejection through flashing. However, this is just estimation, and the reason is not limited thereto.

Also, excellent cracking resistance is achieved by the ink including the second particles that are such inorganic fine particles. The reason is estimated as follows. In a case of performing a recording method using a processing solution, cracking may occur when the temperature drops after the post-heating process if the non-white color ink and the white color ink are recorded in an overlapping manner. This is estimated to be because an ink layer is heated through the post-heating process, the ink layer is then cooled, and contraction rates of the layer of the white color ink and that of the layer of the non-white color ink differ from each other. If the processing solution is used, the constituents of the ink are aggregated and suddenly solidified due to the processing solution, the ink layer is thus formed, and cracking tends to occur in such an ink layer. It is estimated that occurrence of cracking of the first particles is suppressed by the second particles entering the gaps of the first particles in the ink layer. However, this is just estimation, and the reason is not limited thereto.

The content of the second particles is preferably from 1 to 20% by mass, is more preferably from 3 to 10% by mass, and is further preferably from 5 to 7% by mass with respect to 100 parts by mass of the white color pigment. The total content of the first particles and the second particles is preferably from 3 to 20% by mass with respect to the total amount of the white color ink composition. In this manner, it is possible to achieve both image quality (shielding properties and whiteness) that is necessary for the white ink and the clogging resistance.

The content of the second particles is preferably from 0.1 to 5% by mass, is more preferably from 0.5 to 3% by mass, and is further preferably from 0.5 to 2% by mass with respect to 100% by mass of the ink composition.

Resin Particles

The white color ink composition may include resin particles. In this manner, it is possible to improve fixability and abrasion resistance of an image. The resin particles can be used in the form of a resin emulsion.

Although the type of resin is not particularly limited, examples thereof include (meth)acrylic acid, (meth)acrylic acid ester, acrylonitrile, cyanoacrylate, acryl amide (all of which will be referred to as acrylic monomers), a single polymer or a copolymer of olefin, styrene, vinyl acetate, vinyl chloride, vinyl alcohol, vinyl ether, vinyl pyrrolidone, vinyl pyridine, vinyl carbazole, vinyl imidazole, and vinylidene chloride, fluorine resin, natural resin, urethane resin, and polyester resin.

Resin that uses at least an acrylic monomer as a constituent thereof (a monomer constituent used to polymerize resin) is regarded as acrylic resin. The acrylic resin may be a copolymer of an acrylic monomer and a monomer other than the acrylic monomer. The acrylic resin is a single polymer or a copolymer that uses at least the acrylic monomer. Among these examples, a vinyl-acrylic copolymer that uses an acrylic monomer and a vinyl-based monomer is preferably used, a styrene-acryl copolymer that uses styrene from among vinyl-based monomers is more preferably used, and copolymer resin that uses at least styrene and (meth) acrylic acid is further preferably used.

Among the examples of resin, acrylic resin, urethane resin, or polyester resin is preferably used, and the acrylic resin is more preferably used.

Note that the aforementioned copolymer may be in any of forms of a random copolymer, a block copolymer, an alternating copolymer, and a graft copolymer.

Although the aforementioned resin is not particularly limited, the resin can be obtained by a preparation method described below, for example, or a plurality of methods may be combined as needed. Examples of the preparation method include a method of mixing and polymerizing (emulsion polymerization) a polymerization catalyst (polymerization initiator) and a dispersing agent in a monomer of constituents included in desired resin, a method of mixing a solution obtained by dissolving resin with a hydrophilic part in a water-soluble organic solvent in water and then removing the water-soluble organic solvent through distillation, and a method of mixing a solution obtained by dissolving resin in a non-water-soluble organic solvent in an aqueous solution along with a dispersing agent.

The content of the resin is preferably equal to or greater than 1% by mass and equal to or less than 15% by mass, and is more preferably equal to or greater than 2% by mass and equal to or less than 10% by mass, and is further preferably equal to or greater than 3% by mass and equal to or less than 7% by mass. By setting the content of the resin within the aforementioned range, it is possible to improve abrasion resistance, to stably dissolve the resin, and to improve ejection stability.

Wax

The white color ink composition may contain a wax. There is a probability that resin particles are aggregated and fixed with evaporation of moisture, this leads to clogging of nozzles in the recording head, and stable ejection is prevented, in a case in which a recording head is heated. Meanwhile, if the wax is used together, aggregation of polymer particles when the moisture is evaporated is suppressed. In this manner, it is possible to suppress ejection failure and clogging due to the fixation of the resin particles to the nozzles of the recording head and thus to obtain an ink composition with excellent recording stability. Also, the wax prevents a coated film of the resin particles from becoming excessively brittle during high-temperature recording. Therefore, an ink composition with abrasion resistance that tends not to be degraded even at the time of high-temperature recording is obtained.

A melting point of the wax is equal to or greater than 70° C. and less than 110° C. and is more preferably equal to or greater than 80° C. and equal to or less than 110° C. If the melting point falls with the aforementioned range, it is possible to obtain a recorded product with more excellent recording stability and abrasion resistance that tends not to be degraded even at the time of high-temperature recording. Note that the melting point can be measured by a differential scanning calorimeter (DSC). The melting point of the wax can be controlled by adjusting a ratio of a plurality of constituent units that are included in the wax, for example.

The wax preferably contains a polyethylene wax. Although the polyethylene wax with a melting point of equal to or greater than 70° C. and less than 110° C. is not particularly limited, examples thereof include AQUACER 515 polyolefin wax (manufactured by BYK), Nopcote PEM-17 (manufactured by San Nopco), Polylon L787 and Polylon L788 (all of which are manufactured by Chukyo Yushi), and Chemipal W4005 (manufactured by Mitsui Chemicals). The polyethylene wax with a melting point of equal to or greater than 70° C. and less than 110° C. may be synthesized by an ordinary method.

One kind of the waxes may be used alone, or two or more kinds of waxes may be used in combination.

The amount of the wax added in the ink compositions is preferably from 0.1 to 5.0% by mass and is more preferably from 0.5 to 3.5% by mass with reference to the total mass of the ink compositions. If the amount of addition falls within the aforementioned range, excellent recording stability is achieved, and abrasion resistance further tends not to be degraded even at the time of high-temperature recording.

Organic Solvent

The white color ink composition preferably contains an organic solvent and more preferably contains an organic solvent with a standard boiling point of 180 to 250° C. In this manner, it is possible to prevent the organic solvents contained in the ink compositions in the head from being volatilized and to prevent the nozzles from clogging. Also, it is possible to quickly volatilize the organic solvents when the organic solvents are mixed with the ink compositions on the recording medium and to obtain sufficient image quality on a recording medium.

As the aforementioned organic solvent, a nitrogen-containing solvent may be contained. In this manner, it is possible to stably dissolve the resin in the ink composition. Also, the nitrogen-containing solvent has an effect that softening of resin particles contained in the ink composition is prompted, and adhesiveness tends to be improved even in a case in which a heating temperature is low.

Although the nitrogen-containing solvent is not particularly limited, examples thereof include a pyrrolidone-based solvent, an imidazolidinone-based solvent, an amide ether-based solvent, a pyridine-based solvent, a pyrazine-based solvent, and a pyridone-based solvent. The pyrrolidone-based solvent is preferably used, and examples thereof include 2-pyrrolidone, N-methyl-2-pyrrolidone, and N-ethyl-2-pyrrolidone. One kind of nitrogen-containing solvents may be used alone, or two or more kinds of nitrogen containing solvents may be used together. Among the examples of the nitrogen-containing solvent, an amide-based solvent is preferably used. Examples of the amide-based solvent include cyclic amides and acyclic amides. Examples of the cyclic amides include a pyrrolidone-based amide. Examples of the acyclic amides include an amide ether-based solvent with an acyclic structure.

A solvent called alkoxy alkyl amide is exemplified as the amide ether-based solvent, and examples thereof include 3-methoxy-N,N-dimethylpropionamide, 3-methody-N,N-diethyl pripyonamide, 3-methoxy-N,N-methyl ethyl propionamide, 3-ethoxy-N,N-dimethyl pripyonamide, 3-ethoxy-N,N-diethyl propionamide, 3-ethoxy-N,N-methyl ethyl pripionamide, 3-n-butoxy-N,N-dimethyl propionamide, 3-n-butosy-N,N-diethyl propionamide, 3-n-butoxy-N,N-methyl ethyl propionamide, 3-n-propoxy-N,N-dimethyl propionamide, 3-n-propoxy-N,N-diethyl propionamide, 3-n-propoxy-N,N-methyl ethyl propionamidem, 3-iso-propoxy-N,N-dimethyl propionamide, 3-iso-propoxy-N,N-diethyl propionamide, 3-iso-propoxy-N,N-methyl ethyl propionamide, 3-tert-butoxy-N,N-dimethyl propionamide, 3-tert-butoxy-N,N-diethyl propionamide, and the like.

The aforementioned organic solvent may further contain an organic solvent other than the nitrogen-containing solvent. Preferable examples of such an organic solvent include a polyol compound, an alkanediol compound, and a glycol ether compound.

Examples of the polyol compound include polyol of alkane that contains four or less carbon atoms and intermolecular condensates of hydroxyl groups of polyol of alkane that contains four or less carbon atoms. The number of carbon atoms is preferably equal to or less than three. The number of condensed molecules in the intermolecular condensates is preferably two to four.

Examples of the alkanediol compound include diolation products of alkane that contains five or more carbon atoms. The number of carbon atoms is preferably equal to or greater than five and equal to or less than ten and is more preferably equal to or less than seven.

Examples of the glycol ether compound include alkanediol in which one or more hydroxyl group is etherized, examples of ether include alkyl ether and allyl ether, and the former is preferably used.

Although examples of the aforementioned organic solvents and other organic solvents are not particularly limited, specific examples thereof include alcohols or glycols such as ethylene glycol, diethylene glycol, triethylene glycol, propylene glycol, dipropylene glycol, 1,3-propanediol, 1,2-butanediol, 1,2-pentanediol, 1,2-hexanediol, 1,3-butanediol, 1,4-butanediol, 1,5-pentanediol, 1,6-hexanediol, 3-methyl 1,3-hexanediol, diethylene glycol mono-n-propyl ether, ethylene glycol mono-iso-propyl ether, diethylene glycol mono-iso-propyl ether, ethylene glycol mono-n-butyl ether, ethylene glycol mono-t-butyl ether, diethylene glycol mono-n-butyl ether, triethylene glycol monobutyl ether, diethylene glycol mono-t-butyl ether, propylene glycol monomethyl ether, propylene glycol monoethyl ether, propylene glycol mono-t-butyl ether, propylene glycol mono-n-propyl ether, propylene glycol mono-iso-propyl ether, propylene glycol mono-n-butyl ether, dipropylene glycol mono-n-butyl ether, dipropylene glycol mono-n-propyl ether, dipropylene glycol mono-iso-propyl ether, methanol, ethanol, n-propyl alcohol, iso-propyl alcohol, n-butanol, 2-butanol, tert-butanol, iso-butanol, n-pentanol, 2-pentanol, 3-pentanol, and tert-pentanol. One kind of other solvents may be used alone, or two or more kinds of other solvents may be used in combination.

The content of the organic solvent is preferably equal to or greater than 3.0% by mass, is more preferably equal to or greater than 5.0% by mass and equal to or less than 35% by mass, is further preferably equal to or greater than 10% by mass and equal to or less than 35% by mass, and is further preferably equal to or greater than 15% by mass and equal to or less than 30% by mass with respect to the total amount of the ink composition. In this manner, it is possible to quickly volatilize the organic solvent on the recording medium and to obtain sufficient image quality on the recording medium.

The content of the nitrogen-containing solvent is preferably equal to or greater than 3.0% by mass, is more preferably equal to or greater than 5.0% by mass and equal to or less than 30% by mass, is further preferably equal to or greater than 7% by mass and equal to or less than 25% by mass, and is yet further preferably equal to or greater than 10% by mass and equal to or less than 20% by mass with respect to the total amount of the ink composition.

The content of the organic solvent of the polyol compound with the standard boiling point of greater than 280° C. in the white color ink composition is preferably equal to or less than 5% by mass, is preferably equal to or less than 2% by mass, is more preferably equal to or less than 1% by mass, is further preferably equal to or less than 0.5% by mass, is particularly preferably equal to or less than 0.1% by mass, and yet further preferably equal to or less than 0.05% by mass. The lower limit of the content is 0% by mass. If the content of the organic solvent in the ink composition falls within the aforementioned range, drying of the ink on the recording medium is not significantly degraded, and as a result, it is possible to reduce density irregularity of the image and to obtain excellent fixability of the ink on various recording media, in particular, on an ink non-absorbable or low-absorbable recording medium.

Further, the content of the organic solvent with the standard boiling point of greater than 280° C. (not limited to the polyol compound) in the ink composition preferably falls within the aforementioned range with respect to the total mass of the ink composition, degradation of abrasion resistance of a recorded product using the ink composition due to the organic solvent with the boiling point of greater than 280° C. is suppressed, and it is thus possible to obtain a recorded product with excellent abrasion resistance.

Surfactant

The white color ink composition preferably contains a surfactant. Although the surfactant is not particularly limited, examples thereof include an acetylene glycol-based surfactant, a fluorine-based surfactant, and a silicone-based surfactant. Among the examples, the acetylene glycol-based surfactant and the silicone-based surfactant are preferably used.

The content of the surfactant is preferably from 0.1 to 2.0% by mass, is more preferably from 0.1 to 1.7% by mass, and is further preferably from 0.1 to 1.5% by mass with respect to 100% by mass of the ink composition. If the content of the surfactant is equal to or less than 2.0% by mass, abrasion resistance tends to be further improved. Also, if the content of the surfactant is equal to or greater than 0.1% by mass, filling properties of the obtained recorded product are further improved, and ejection stability tends to be further improved.

Water

The white color ink composition contains water. Examples of water include ion include pure water such as ion-exchanged water, ultrafiltrated water, reverse osmosis water, and distilled water and ultrapure water from which ionic impurities have been removed as much as possible. If water sterilized by performing ultraviolet irradiation, adding hydrogen peroxide, or the like is used, it is possible to prevent mold or bacteria from being generated in a case in which a pigment dispersion and ink using the pigment dispersion are stored for a long period of time.

Although the content of water is not particularly limited, the content of water is preferably larger than the content of the organic solvent in the invention. The ink is so-called "water-based ink", and at least water is contained as a main constituent in solvent constituents contained in the ink. The content of water is preferably from 40 to 95% by mass, is more preferably from 45 to 90% by mass, and is further preferably from 50 to 80% by mass with respect to 100% by mass of the water-based ink composition.

Other Constituents

Various additives such as solubilizer, a viscosity adjuster, a pH adjuster, an antioxidant, an antiseptic agent, a fungicide, and a corrosion inhibitor in order to satisfactorily maintain storing stability and ejection stability from the head and a chelating agent for capturing metal ions that affect dispersion can be appropriately added to the ink used in the embodiment.

Non-White Color Ink Composition

A non-white color water-based ink composition other than the white color ink composition may be used in addition to the white color ink composition in the ink jet recording method according to the embodiment. The non-white color water-based ink composition is preferably a colored ink composition other than the white color ink composition. The colored ink composition is an ink composition that is used to color the recording medium.

Although the non-white color water-based ink composition will also be referred to as a color ink composition, the non-white color water-based ink composition may be a black ink composition and indicates any colored ink composition of a non-white color. The color ink composition is also preferably a water-based ink composition, and the content of water in the composition is preferably equal to or greater than 40% by mass.

Coloring Material

The color ink composition includes a non-white color coloring material. The non-white color coloring material indicates a coloring material other than a white color coloring material. Although a pigment or a dye can be used as the non-white color coloring material, a pigment is preferably used. Although the pigment is not particularly limited, the following pigments can be listed, for example.

Although a black pigment is not particularly limited, examples thereof include No. 2300, No. 900, MCF88, No. 33, No. 40, No. 45, No. 52, MA7, MA8, MA100, No. 2200B, and the like (all of which are manufactured by Mitsubishi Chemical Corporation), Raven 5750, Raven 5250, Raven 5000, Raven 3500, Raven 1255, Raven 700, and the like (all of which are manufactured by Carbon Columbia), Regal 400R, Regal 330R, Regal 660R, Mogul L, Monarch 700, Monarch 800, Monarch 880, Monarch 900, Monarch 1000, Monarch 1100, Monarch 1300, Monarch 1400, and the like (all of which are manufactured by CABOT JAPAN K.K.), and Color Black FW1, Color Black FW2, Color Black FW2V, Color Black FW18, Color Black FW200, Color Black S150, Color Black S160, Color Black S170, Printex 35, Printex U, Printex V, Printex 140U, Special Black 6, Special Black 5, Special Black 4A, Special Black 4, and the like (all of which are manufactured by Degussa).

Although a yellow pigment is not particularly limited, examples thereof include C.I. Pigment Yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 167, 172, and 180.

Although a magenta pigment is not particularly limited, examples thereof include C.I. Pigment Red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48(Ca), 48(Mn), 57(Ca), 57:1, 88, 112, 114, 122, 123, 144, 146, 149, 150, 166, 168, 170, 171, 175, 176, 177, 178, 179, 184, 185, 187, 202, 209, 219, 224, and 245, and C.I. Pigment Violet 19, 23, 32, 33, 36, 38, 43, and 50.

Although a cyan pigment is not particularly limited, examples thereof include C.I. Pigment Blue 1, 2, 3, 15, 15:1, 15:2, 15:3, 15:34, 15:4, 16, 18, 22, 25, 60, 65, and 66, and C.I. Vat Blue 4 and 60.

Although a pigment that is used in color ink of a color other than magenta, cyan, and yellow is not particularly limited, examples thereof include C.I. Pigment Green 7 and 10, C.I. Pigment Brown 3, 5, 25, and 26, C.I. Pigment Orange 1, 2, 5, 7, 13, 14, 15, 16, 24, 34, 36, 38, 40, 43, and 63.

Although a pearl pigment is not particularly limited, examples thereof include a pigment that has pearly glossiness or interference glossiness such as titanium dioxide-coated mica, fish scales, and oxy-bismuth chloride.

Although a metallic pigment is not particularly limited, particles of a single body or an alloy of aluminum, silver, gold, platinum, nickel, chromium, tin, zinc, indium, titanium, or copper.

The content of the pigment is preferably from 0.4 to 12% by mass, is more preferably from 1 to 8% by mass, and is further preferably from 2 to 5% by mass with respect to 100% by mass of the ink composition.

The color ink composition preferably includes resin particles, a wax, an organic solvent, and a surfactant similarly to the white color ink composition. These constituents are as described above in the section for the white color ink composition. Materials that form the respective constituents and amounts of addition may be appropriately changed in accordance with the type of the ink composition. In addition, various additives such as a dissolution aid, a viscosity adjuster, a pH adjuster, an antioxidant, an antiseptic, a fungicide, a corrosion inhibitor, and a chelating agent for capturing metal ions that affect dispersion can appropriately be added.

Processing Solution

The ink jet recording method according to the embodiment preferably includes a process of causing the processing solution that includes an aggregating agent for aggregating the constituents of the ink composition to adhere to the recording medium. The processing solution is a water-based composition that includes water as one of main solvent constituents of the composition, and the content of water in the composition is preferably equal to or greater than 40% by mass. The processing solution may further contain an organic solvent. It is possible to achieve excellent image quality and the like of the ink compositions using the processing solution. Meanwhile, glossiness of the image may be degraded. The reason is estimated to be because the constituents of the ink are aggregated with the processing solution and an ink film tends not to be smoothed. The processing solution is preferably caused to adhere to the recording medium before the ink compositions are caused to adhere. It is possible to improve image quality as compared with the ink compositions are caused to adhere directly to the recording medium by coating the recording medium with the processing solution in advance. The constituents in the processing solution will be described below. The ink composition, the constituents of which are to be aggregated, may be the white color ink composition or the non-white color ink composition.

Aggregating Agent

The aggregating agent has a function of aggregating the coloring material along with the resin included in the ink composition by reacting with any of the constituents included in the ink composition, preferably either the coloring material or the resin. In this manner, it is possible to aggregate the coloring material in ink droplets after landing, to increase the viscosity, to suppress interference between the ink droplets, and to form an image within density irregularity.

One or more kinds of polyvalent metal salts, organic acids, and cationic polymers is preferably used, any one of polyvalent metal salts and cationic polymers is more preferably used, and the former is further preferably used as the aggregating agent. The content of the aggregating agent included in the processing solution is preferably from 0.5 to 20% by mass, is more preferably from 1 to 15% by mass, and is further preferably from 2 to 10% by mass. In this manner, it is possible to aggregate the constituents of the ink composition and to thus improve image quality.

The polyvalent metal compounds are compounds, each of which is formed with a polyvalent metal ion with a valence of two or more and anion. Examples of the polyvalent metal ion with a valence of two or more include $Ca^{2+}$, $Mg^{2+}$, $Cu^{2+}$, $Ni^{2+}$, $Zn^{2+}$, and $Ba^{2+}$. Examples of anion include $Cl^-$, $No_3^-$, $CH_3COO^-$, $I^-$, $Br^-$, and $ClO_3^-$. Among these examples, a magnesium salt, a calcium salt, and an aluminum salt can preferably be used from the viewpoint that the aforementioned aggregating effect is further enhanced.

Although the organic acids are not limited to those listed below, examples thereof include a succinic acid, an acetic acid, a propionic acid, and a lactic acid.

Although the cationic polymers are not limited to the cationic polymers listed below, and preferable examples include an amine-based polymer. Examples of the amine-based polymer include polyamine resin, polyamide resin, and polyallylamine resin, and the amine-based polymer is resin that has an amino group in the structure.

The polyamine resin is resin that has an amino group in a main skeleton of resin, and examples thereof include resin that is generated from epihalohydrin and an amine compound. The polyallylamine resin may be a quaternary salt of polyallylamine. The polyamide resin is resin that has an amide group in a main skeleton. The polyamide resin is a cationic polymer that is soluble in water and is positively charged in water.

The content of the aggregating agent in the processing solution is preferably from 0.5 to 15% by mass, is more preferably from 1 to 10% by mass and is further preferably from 2 to 5% by mass. The content of the aggregating agent in the processing solution is preferably from 0.1 to 1.5 mol/kg in terms of molar concentration. The lower limit of the content of the aggregating agent in the processing solution is more preferably equal to or greater than 0.2 mol/kg. The upper limit of the content of the aggregating agent in the processing solution is more preferably equal to or less than 1.0 mol/kg and is further preferably equal to or less than 0.6 mol/kg. In this manner, it is possible to keep a satisfactory balance with other properties such as abrasion resistance while improving image quality.

Organic Solvent

The processing solution preferably includes an organic solvent and further preferably includes an organic solvent with a standard boiling point from 180 to 250° C. In this manner, it is possible to prevent the organic solvent included in the processing solution in the head from being volatilized and to prevent nozzle clogging. Also, it is possible to quickly volatilize the organic solvent when the organic solvent is mixed with the ink compositions on the recording medium and to obtain sufficient image quality on the recording medium.

A nitrogen-containing solvent may be included as the aforementioned organic solvent. It is possible to stably dissolve the resin in the ink compositions and to mix the resin with the ink compositions. Also, the nitrogen-containing solvent has an effect of promoting softening of resin particles included in the ink compositions, and adhesiveness tends to be improved even in a case in which the heating temperature is low. The nitrogen-containing solvent and other organic solvents that are similar to those described above for the ink compositions can be used.

The content of the organic solvent is preferably equal to or greater than 3.0% by mass, is more preferably equal to or greater than 5.0% by mass and equal to or less than 45% by mass, is further preferably equal to or greater than 10% by mass and equal to or less than 40% by mass, and is further preferably equal to or greater than 15% by mass and equal to or less than 35% by with respect to the total amount of the processing solution. In this manner, an appropriate degree of aggregation of the constituents of the ink compositions can be achieved when the ink compositions and the processing solution are mixed. Also, it is possible to quickly volatilize the organic solvent when the organic solvent is mixed with the ink compositions on the recording medium and to obtain sufficient image quality on an ink non-absorbable or low-absorbable recording medium.

The content of the organic solvent with the standard boiling point of greater than 280° C. in the processing solution is preferably equal to or less than 2% by mass. Examples of the organic solvent with the boiling point of greater than 280° C. include a polyol compound. If the content of the organic solvent in the processing solution falls within the aforementioned range, the drying properties of the processing solution on the recording medium are not significantly regraded, which is preferable. As a result, excellent reduction of image bleeding and abrasion resistance are achieved on various recording medium, in particular, on an ink non-absorbable or low-absorbable recording medium, which is preferable.

The content of the organic solvent with the standard boiling point of greater than 280° C. in the processing solution is more preferably equal to or less than 1% by mass, is further preferably equal to or less than 0.5% by mass, is particularly preferably equal to or less than 0.1% by mass, and is yet further preferably equal to or less than 0.05% by mass with respect to the total mass of the ink compositions. The lower limit of the content is 0% by mass. If the content falls within the aforementioned range, degradation of abrasion resistance of a recorded product due to the organic solvent with the standard boiling point of greater than 280° C. is suppressed, and it is possible to obtain a recorded product with more excellent abrasion resistance.

The processing solution may contain other constituents such as a surfactant, resin, a sizing agent (for example, starch substances, cellulose-based substances, polysaccharide, protein, and a water-soluble polymer), a pH adjuster, an antiseptic, and a fungicide.

Herein, in the case in which the processing solution is used, an increase rate (aggregation viscosity increase rate) of viscosity of the white color ink composition after being mixed with the processing solution is preferably equal to or less than 2.5 times. The aggregation viscosity increase rate is defined by an increase in viscosity of a mixture solution measured at 25° C. after mixing the ink and the processing solution at a mass ratio of 10:1 and stirring the ink and the processing solution for 1 minute with respect to the viscosity of the ink before the mixing. This is because the aggregation viscosity increase rate of the white color ink composition is preferably lower such that the aggregating agent in the processing solution is not consumed. The increase rate is more preferably equal to or less than 2 times and is further preferably equal to or less than 1.5 times. Also, since the white color ink composition itself contains a solid content and the viscosity thereof thus tends to increase due to drying, the white color ink composition may not react the aggregating agent, or a white color ink composition with viscosity that does not change due to mixing may also be used, or the increase rate may be equal to or greater than 0.8 times, for example.

The increase rate of the viscosity of the ink can be raised by using a constituent that tends to be aggregated with the aggregating agent included in the ink and can be lowered by using a constituent that tends not to be aggregated. Examples of such a constituent include a pigment and resin.

The aforementioned aggregation viscosity increase rate of the color ink composition is preferably greater than 2.5 times. It is possible to improve color image quality by the aggregation viscosity increase rate of the color ink composition being greater than that of the white color ink composition. Although cracking tends to occur as the difference between the aggregation viscosity increase rate of the white color ink composition and the aggregation viscosity increase rate of the color ink composition increases, it is possible to reduce the cracking by adding the inorganic fine particles to the white color ink composition.

Recording Apparatus

The recording apparatus according to the embodiment is a recording apparatus that performs recording by the recording method according to the embodiment. Hereinafter, an example of a configuration of the recording apparatus according to the embodiment will be described.

FIG. 1 illustrates an outline sectional view of an example of the recording apparatus (ink jet apparatus) that is used in the ink jet recording method according to the embodiment. As illustrated in FIG. 1, an ink jet apparatus 100 includes a carriage 2, an ink jet head 3, a platen 4, a platen heater 4*a*, a post-heater 5, a cooling fan 5*a*, a pre-heater 7, an IR heater 8, and a ventilation fan 8*a*. Note that the cooling fan 5*a*, the pre-heater 7, the IR heater 8, and the ventilation fan 8*a* are used as needed and can be omitted.

The ink jet head 3 is mounted on the carriage 2 and includes a plurality of nozzle arrays for ejecting the ink compositions. The respective nozzle arrays include a plurality of nozzle holes aligned therein. The ink jet recording apparatus 100 is a so-called serial-type ink jet recording apparatus. The serial-type ink jet recording apparatus means an ink jet recording apparatus in which the ink jet head 3 is mounted on the carriage 2 that moves in a predetermined direction and liquid droplets are ejected onto a recording medium by the ink jet head 3 moving with movement of the carriage 2 in a main scanning direction. The carriage 2 performs main scanning to cause ink to adhere to the recording medium by ejecting the ink from the ink jet head 3 mounted on the carriage 2 while moving in the main scanning direction that corresponds to a front side-further side direction in the drawing. The ink jet head 3 may include a head that ejects the first ink composition and a head that is arranged on the downstream side of the first head and ejects the second ink composition. Alternatively, the ink jet head 3 may be a single head including a nozzle array that ejects the first ink composition and a nozzle array that ejects the second ink composition.

Also, the ink jet head 3 is preferably configured to eject the processing solution as well. In this case, it is only necessary for the ink jet head 3 to include a head for ejecting the processing solution on the upstream side of the head for ejecting the first ink composition. Alternatively, the ink jet head 3 may include a nozzle for ejecting the processing solution on the upstream side of a nozzle array for ejecting the first ink composition.

Although not illustrated in the drawing, the ink jet head 3 preferably includes a mechanism of circulating the white color ink composition at the nozzles or at flow paths to the nozzles. However, it is not possible to circulate the ink at the tip ends of the nozzles and to avoid clogging due to the drying of the ink at the tip ends of the nozzles even if such a circulation mechanism is provided. Therefore, the configuration of the white ink composition defined in the embodiment is also effective in such a case.

The platen heater 4*a* is used when the recording medium is heated in a process of causing the ink compositions to adhere. It is possible to heat the recording medium on a side opposite to the ink jet head 3 by using the platen heater 4*a*. In this manner, the ink jet head 3 relatively tends not to be heated.

The post-heater 5 is for secondary-drying and solidifying the ink compositions recorded on a recording medium 1. Moisture and the like contained in the ink composition are quickly evaporated and fly, and a film is formed with polymer particles contained in the ink compositions by the post-heater 5 heating the recording medium 1 on which an image has been recorded. In this manner, an ink dried product is fixed (bonded) to the recording medium, and an image with excellent abrasion resistance and high image quality can be obtained in a short time.

The cooling fan 5*a* is used to form a coated film with satisfactory adhesiveness on the recording medium by cooling the ink composition on the recording medium after drying the recording medium by the post-heater 5.

The pre-heater 7 is for heating the recording medium in advance (pre-heating) before the ink composition is ejected to the recording medium.

The IR heater 8 is used as needed and is used to heat the recording medium from the side of the ink jet head 3 in the process of causing the ink compositions to adhere. In this manner, the ink jet head 3 is also heated at the same time, and the temperature can be raised without being affected by the thickness of the recording medium as compared with a case in which the heating is performed from the rear surface of the recording medium, such as a case in which the platen heater 4*a* is used. The ventilation fan 8*a* is used to more efficiently dry the ink compositions that has adhered to the recording medium 1.

Figure 2:
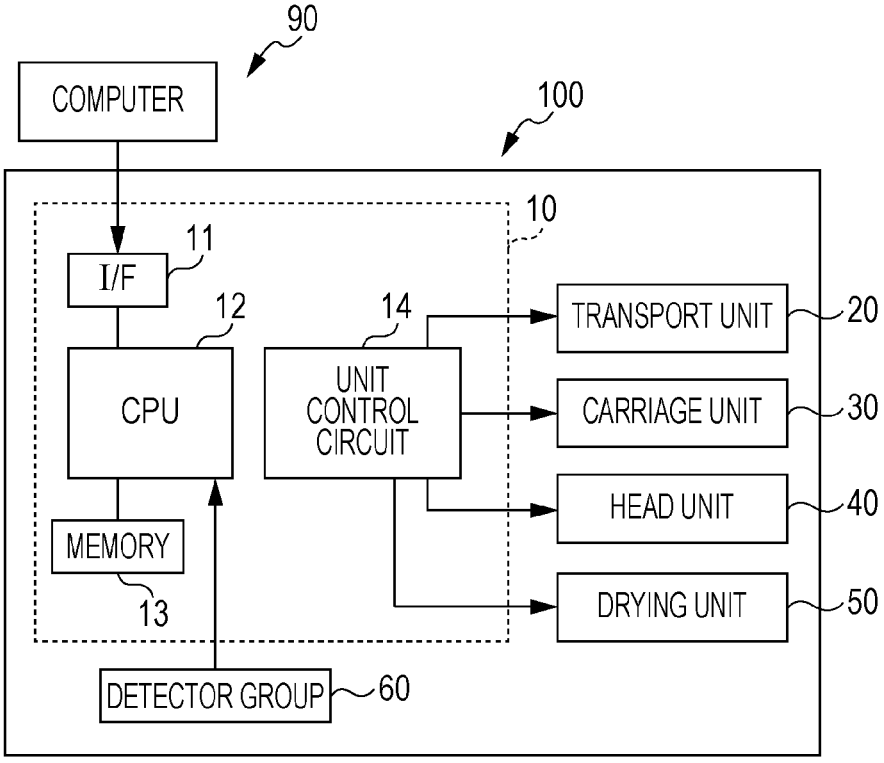
FIG. 2 is a block diagram of the ink jet apparatus that is used in the ink jet recording method according to the embodiment.

FIG. 2 is a functional block diagram of the ink jet recording apparatus 100. The controller 10 is a control unit that performs control of the ink jet recording apparatus 100. An interface unit 11 (I/F) is for transmitting and receiving data between the computer 90 and the ink jet recording apparatus 100. A CPU 12 is an arithmetic processing device for performing overall control of the ink jet recording apparatus 100. A memory 13 is for securing a region in which a program of the CPU 12 is stored, a working region, and the like. The CPU 12 controls the respective units using a unit control circuit 14. Note that a detector group 60 monitors conditions in the ink jet recording apparatus and the controller 10 controls the respective units on the basis of the detection results.

A transport unit 20 is for controlling sub scanning (transport) of ink jet recording, and specifically, the transport unit 20 controls a transport direction and a transport speed of the recording medium 1. Specifically, the transport direction and the transport speed of the recording medium 1 are controlled by controlling a rotation direction and a rotation speed of a transport roller that is driven by a motor.

A carriage unit 30 is for controlling the main scanning (pass) of ink jet recording, and specifically, the carriage unit 30 is for reciprocating the ink jet head 3 in the main scanning direction. The carriage unit 30 includes the carriage 2 on which the ink jet head 3 is mounted and a carriage moving mechanism for reciprocating the carriage.

The head unit 40 is for controlling the amount of the processing solution or the ink composition ejected from the nozzles of the ink jet head. In a case in which the nozzles of the ink jet head are designed to be driven by piezoelectric elements, for example, operations of the piezoelectric elements in the respective nozzles are controlled. The head unit 40 controls the dot sizes of the processing solution in a time from adhesion of the processing solution to adhesion of the ink. The amount of the processing solution adhering per scanning is controlled depending on a combination of control of the carriage unit 30 and the head unit 40.

A drying unit 50 controls temperatures of various heaters such as the IR heater, the pre-heater, the platen heater, and the post-heater.

The aforementioned ink jet recording apparatus 100 alternately repeats an operation of causing the carriage 2 with the ink jet head 3 mounted thereon to move in the main scanning direction and a transport operation (sub scanning). At this time, the controller 10 controls the carriage unit 30 when each pass is performed, moves the ink jet head 3 in the main scanning direction, controls the head unit 40, causes predetermined nozzle holes of the ink jet head 3 to eject liquid droplets of the processing solution or the ink compositions, and causes the liquid droplets of the ink compositions to adhere to the recording medium 1. The controller 10 controls the transport unit 20 and causes the transport unit 20 to transport the recording medium 1 in the transport direction by a predetermined transport amount during the transport operation.

A recording region to which a plurality of liquid droplets (dots) have been caused to adhere is gradually transported by the pass and the transport operations being repeated. Then, the liquid droplets that have been caused to adhere to the recording medium are dried by the post-heater 5, thereby completing an image. Thereafter, the completed recorded product may be wound into a roll shape using a winding mechanism (not illustrated) or may be transported by a flatbed mechanism (not illustrated).

Figure 3:
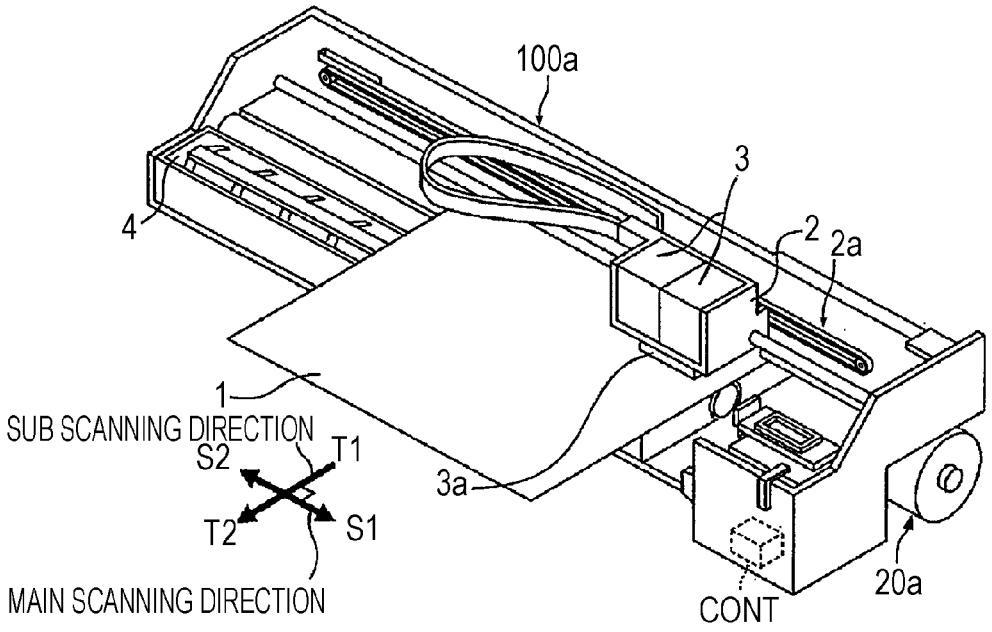
FIG. 3 is a schematic view of surroundings of a carriage in one example of the ink jet apparatus that is used in the ink jet recording method according to the embodiment.

FIG. 3 is a perspective view illustrating an example of a configuration in the surroundings of the carriage of the recording apparatus in FIG. 1. This is a part of the example of the configuration of the serial-type ink jet recording apparatus. A configuration 100*a* in the surroundings of the carriage has a carriage 2, an ink jet head 3 that is mounted on the carriage 2, a member 3*a* that includes nozzles that are a part of the ink jet head 3 and eject ink, an ink accommodation body (not illustrated), and an ink supply path (not illustrated) such as an ink supply tube that supplies the ink from the ink accommodation body to the ink jet head 3. The ink accommodation body may be provided at a location other than the carriage 2 or may be provided at the carriage. Also, the configuration 100*a* includes a platen 4, which is disposed below the carriage 2, to which a recording medium P is transported, a carriage moving mechanism 2*a* that causes the carriage 2 to move relative to the recording medium P, a transport mechanism 20*a* that is a roller that transports the recording medium P in the sub scanning direction (transport direction), and a control unit CON that controls operations of the carriage 2 and the like. The direction S1-S2 corresponds to the main scanning direction, and the direction T1→T2 corresponds to the sub scanning direction. Note that main scanning is performed on any one sides in the main scanning direction (the left-right direction of the apparatus) in the main scanning performed once.

Meanwhile, the line-type ink jet recording apparatus may be used as the recording apparatus. In the recording apparatus in FIG. 1, for example, the ink jet head 3 is configured as a line head, which extends in the width direction (the furthest and the closest direction in FIG. 1) of the recording medium, in which the length of the ink jet head in the width direction is equal to or greater than the length of the recording region on the recording medium in the width direction. The position of the line head is fixed during the recording. The recording is performed by performing scanning, in which the ink is ejected from the line head and is caused to adhere to the recording medium while the recording medium is transported, once. This is a line-type recording method. It is also possible to perform recording using a plurality of types of compositions by arranging a plurality of line heads from the upstream side to the downstream side in the transport direction of the recording medium and causing the respective line heads to eject different compositions. In a case in which the line-type ink jet recording apparatus is used as the recording apparatus, configurations of the recording apparatus other than the configuration of the ink jet head and the recording method can be similar to those in FIG. 1.

Recording Medium

In the embodiment, a non-absorbable or low-absorbable recording medium is preferably used as the recording medium 1. Filing properties due to repelling of the water-based ink composition further tend to be degraded as the non-absorbable recording medium or the low-absorbable recording medium is further low-absorbable or non-absorbable. Thus, it is advantageous to use the ink jet recording method according to the embodiment for such a recording medium. The non-absorbable recording medium or the low-absorbable recording medium are useful since the recording medium itself has water resistance and durability and recorded products can be utilized for various purposes.

Here, the "low-absorbable recording medium" or the "non-absorbable recording medium" means a recording medium with a water absorption amount of equal to or less than 10 mL/m2 in 30 msec from a start of contact in the Bristow method. The Bristow method is a method that has been most widely distributed as a method of measuring a liquid absorption amount in a short time and has also been employed by JAPAN TAPPI. Details of the test method are described in Standard No. 51 "Paper and plate paper-liquid absorbability test method-Bristow method" in "JAPAN TAPPI paper pulp test method 2000".

Also, the non-absorbable recording medium or the low-absorbable recording medium can also be classified depending on wettability of the recording surface with respect to water. For example, the recording medium can be characterized by dropping 0.5 μL of water droplets on a recording surface of the recording medium and measuring a contact angle decrease rate (comparison between a contact angle at 0.5 milliseconds after landing and a contact angle at 5 seconds). More specifically, as characteristics of the recording medium, non-absorbability of the "non-absorbable recording medium indicates that the aforementioned decrease rate is less than 1% while the low-absorbability of the "low-absorbable recording medium" indicates that the aforementioned decrease rate is equal to or greater than 1% and less than 5%. In addition, the absorbability indicates that the aforementioned decrease rate is equal to or greater than 5%. Note that the contact angles can be measured using a portable contact angle meter PCA-1 (manufactured by Kyowa Interface Science).

Although the low-absorbable recording medium is not particularly limited, examples thereof include coated paper with a coated layer for receiving oil-based ink provided on the surface thereof. Although the coated paper is not particularly limited, examples thereof include recording sheets such as art paper, coating applied paper, matte paper.

Although the non-absorbable recording medium is not particularly limited, examples thereof include a plastic film that does not have an ink absorption layer, a recording medium obtained by coating a base material such as paper with plastic, and a recording medium with a plastic film bonded thereto. Examples of the plastic described herein include polyvinyl chloride, polyethylene terephthalate, polycarbonate, polystyrene, polyurethane, polyethylene, and polypropylene.

Further, it is also possible to use an ink non-absorbable or low-absorbable recording medium such as a plate made of metal such as iron, silver, copper, or aluminum or glass in addition to the aforementioned recording medium.

The width of the recording medium in the main scanning direction is preferably equal to or greater than 50 cm, is more preferably from 80 to 500 cm, is further preferably from 90 to 350 cm, is further preferably from 100 to 350 cm, and is particularly preferably from 130 to 300 cm. In a case in which the width of the recording medium in the main scanning direction falls within the aforementioned range, it is possible to record a recorded product that is useful for display or the like. Meanwhile, although drying during the scanning tends to occur, it is possible to suppress nozzle clogging according to the embodiment.

Ink Jet Recording Method

The ink jet recording method according to the embodiment has an ink adhesion process of causing the aforementioned white color ink composition to adhere to a heated recording medium. Hereinafter, the recording method will be described in accordance with the procedure.

Recording Medium Heating Process

The ink jet recording method according to the embodiment includes a process of heating a recording medium 1 before or during the ink adhesion process. The heating of the recording medium 1 is performed using the platen heater 4*a*, for example. However, a mechanism that heats the recording medium is not limited to the platen heater, and a blowing mechanism that feeds air with heat to the recording medium or a mechanism that emits radiation that generates heat to the recording medium.

Processing Solution Adhesion Process

The ink jet recording method according to the embodiment preferably includes a process of causing the processing solution to adhere to the recording medium. The processing solution adhesion process is a process in which the processing solution that contains the aggregating agent for aggregating the ink compositions is caused to adhere to the recording medium. The aggregating agent has a function of reacting with a pigment that contains the ink compositions, pigment dispersion resin that can be contained in the ink compositions, and the like and aggregating the pigment. In this manner, it is possible to suppress occurrence of bleeding or the like of an image recorded using the ink composition and to obtain an image with excellent image quality. In contrast, although there is a trend that cracking tends to occur, the invention is preferable since it is possible to reduce the cracking.

In the embodiment, adhesion of a processing solution is preferably performed on the recording medium to which the ink composition has been caused to adhere in main scanning before the main scanning or in the main scanning, and the former is more preferable. Note that the timing of the adhesion of the processing solution is not limited to the aforementioned form.

An adhesion region in which the amount of the adhering processing solution is 5 to 20% by mass of the amount of the adhering white color ink composition in the ink composition adhesion process, which will be described later, is preferably formed on the recording medium. In this manner, it is possible to aggregate the constituents of the white color ink composition and further the color ink composition and thereby to improve white image quality and color image quality.

Ink Composition Adhesion Process

The ink composition adhesion process is a process of causing an ink set that includes the white color ink composition and the color ink composition to eject from the ink jet head and causing the ink set to adhere to the low-absorbable or non-absorbable recording medium 1. The order in which the white color ink composition and the color ink composition are ejected is not limited. Also, it is preferable to record the image of the white color ink composition and the image of the color ink composition such that the images overlap with each other on the recording medium.

In the embodiment that is performed by the serial-type recording method, the ink composition adhesion process is performed by alternately performing scanning in which the ink composition is ejected while the relative positions of the ink jet head including the ink set and the recording medium are changed in the sub scanning direction and sub scanning in which the recording medium is transported. The ink composition adhesion process is performed by performing the scanning a plurality of times in this manner. This is a so-called serial-type recording method. In the embodiment, the maximum time of the scanning performed once is equal to or greater than 0.8 seconds.

"The maximum time of the scanning performed once" is a time in which one point of the ink jet head faces the recording medium in a case in which recording is performed from an end to an end of the recording medium in the scanning direction in the scanning performed once. Note that scanning may be performed in a shorter time than the aforementioned maximum time of the scanning performed once in accordance with an image to be recorded when the recording method is performed. The maximum time of the scanning performed once is preferably from 0.8 to 5 seconds, is more preferably equal to or greater than 0.8 seconds and equal to or less than 4 seconds, is further preferably equal to or greater than 1 second and equal to or less than 3 seconds, and is particularly preferably from 1.5 to 2.5 seconds. The scanning performed once is also referred to as one pass.

The maximum time of the scanning performed once that falls within the aforementioned range is preferable since it is possible to create a recorded product on a recording medium with a wide width that is effective for display. Meanwhile, although drying of the ink at the nozzles during scanning tends to occur and clogging tends to occur if the maximum time of the scanning is longer, excellent clogging resistance is achieved in the embodiment, which is preferable. Note that an average scanning speed in the scanning is preferably from 60 to 100 cm/second, for example.

The surface temperature of the recording medium during the ink composition adhesion is preferably from 27 to 45° C., is more preferably from 28 to 43° C., is further preferably from 30 to 40° C., and is particularly preferably from 32 to 38° C. The temperature is a surface temperature at a portion, which receives adhesion of the ink, on a recorded surface of the recording medium in the adhesion process, and in a case in which recording is performed for a long time, the temperature is an average temperature during the recording. The surface temperature that falls within the aforementioned range is preferable in terms of more excellent image quality, abrasion resistance, reduction of clogging, and high glossiness. In the case in which the surface temperature falls within the aforementioned range, the embodiment is preferable since it is possible to reduce positional deviation of the ink although drying tends to occur during the scanning.

Number of Times Scanning is Performed

The number of times the scanning is performed is also referred to as the number of passes. In the case of the serial-scheme recording method, the number of times of scanning, in which nozzle groups used for recording a certain composition faces and passes through a certain position to be recorded on a recording medium, is performed is referred to as the number of times the scanning is performed with the composition. The number of times the scanning is performed is decided for each composition. In a case in which a nozzle array is filled with certain ink and the nozzle array is used for recording, and in a case in which the distance of sub scanning performed once is a distance corresponding to one second of the length of the nozzle array in the sub scanning direction, for example, the number of times scanning is performed with the ink is two. A larger number of times scanning is performed is more preferable since it is possible to increase the total amount of composition to be caused to adhere and it is possible to cause the composition to adhere in a divided manner over scanning performed a plurality of times. Meanwhile, a smaller number of times the scanning is performed is preferable in terms of a high recording speed. The number of times the scanning is performed can be increased by reducing the distance of the sub scanning performed once and can be reduced by increasing the distance.

Post-Heating Process

The ink jet recording method according to the embodiment preferably includes a post-heating process of further heating the recording medium in the ink adhesion process. The post-heating process is performed with the post-heater 5, for example. In this manner, the ink composition on the recording medium is dried, the resin included in the ink composition is melted, and it is possible to form a recorded product with satisfactory filling properties. The heating temperature of the recording medium in the post-heating process is preferably equal to or greater than 60° C., is more preferably from 60 to 150° C., is further preferably equal to or greater than 70° C. and equal to or less than 120° C., and is further preferably equal to or greater than 80° C. and equal to or less than 110° C. If the heating temperature falls within the aforementioned range, abrasion resistance tends to be further improved.

According to the ink jet recording method of the embodiment, it is possible to perform such recording that excellent shielding properties, whiteness, and clogging resistance are achieved. As a result, it is also possible to improve color image quality.

Embodiment of Ink Jet Recording Method According to Second Invention

The embodiment of the first invention has been described above. Hereinafter, an embodiment of the second invention will be described.

According to the second invention, an ink jet recording method includes a process of causing a processing solution that includes an aggregating agent for aggregating constituents of a white color water-based ink composition to adhere to a recording medium and an ink adhesion process of ejecting the white color water-based ink composition from an ink jet head to the recording medium and causing the white color water-based ink composition to adhere to the recording medium. In the ink jet recording including the aforementioned process, the white color water-based ink composition that contains first particles that are a white color pigment and second particles that are inorganic fine particles and that are particles of a different kind from the first particles.

Some advantages of the second invention are to improve image quality, cracking resistance, and whiteness of the non-white color ink in a case in which the non-white color ink is recorded such that the non-white color ink overlaps with the white color ink. The improvement of the image quality of the non-white color ink can be achieved using the processing solution, and excellent cracking resistance can be achieved using the ink composition that includes the second particles against occurrence of cracking due to the utilization of the processing solution.

Note that it is not necessary to cause the ink to adhere to the recording medium heated in the heating process according to the second invention.

As described above, cracking tends to occur in a case in which the non-white color image is recorded such that the non-white color image is recorded on a white color image. This is estimated to be because a contraction rate of the white image and a contraction rate of the color image differ from each other after the heating and drying.

As a side note, since the average particle diameter of the white color pigment used in the white color pigment is relatively large, and the content thereof is relatively large, the contraction rate of the ink layer thereof may differ from that of the non-white color ink. It is estimated that the cracking can be reduced by causing the contraction rate of the white image to approach that of the non-white color image by the inorganic fine particles entering between the white color pigment, or alleviating stress at the time of contraction. Cracking in the coated film tends to deteriorate due to aggregation of the non-white color ink composition when the processing solution is used. The inventors have discovered that the inorganic fine particles are effective for cracking resistance when the processing solution is used.

The aforementioned configuration of the first invention can be used for the second invention other than the aforementioned points. The respective processes in the ink jet recording method and the compositions and the processing solution used in the respective processes according to the second invention are as described above in the embodiment of the first invention.

Examples

Hereinafter, the invention will be more specifically described using examples and comparative examples. The invention is not limited to the following examples at all. Note that the examples described below as "Examples" are examples corresponding to the first invention and the examples described below as "Examples" correspond to the comparative examples in the second invention.

Preparation of Processing Solution and Ink Composition

The respective materials were mixed with the compositions (% by mass) shown in Table 1 below and were sufficiently stirred, thereby preparing various processing solutions and white color ink compositions. The content of the pigments, the resin, the waxes are content in the ink or the like in terms of solid content. In the examples, white color ink compositions were prepared as the first ink compositions, and the non-white color ink composition, specifically, cyan ink compositions were prepared as the second ink compositions. As the pigments, dispersant resin (water-soluble styrene-acrylic resin) was mixed with water at a mass ratio between the pigment and dispersant resin of 6:1 and was stirred with a bead mill, thereby preparing pigment dispersions, and these were used to prepare the ink. In a case in which hydrate of a polyvalent metal salt was used as the aggregating agent, the solid content excluding water of hydrate was regarded as the solid content.

TABLE 1

| | | White ink | | | | | | | |
|---|---|---|---|---|---|---|---|---|---|
| | Constituents | WH-A | WH-B | WH-C | WH-D | WH-E | WH-F | WH-G | WH-H |
| | Aggregating agent A | 0 | 0 | 0 | 0 | 0 | 0 | 0 | 0 |
| | Aggregating agent B | 0 | 0 | 0 | 0 | 0 | 0 | 0 | 0 |
| First Particles | Titanium dioxide; average particle size of 300 nm | 10 | 10 | 10 | 7 | 15 | 10 | 10 | 0 |
| | Titanium dioxide; average particle size of 210 nm | 0 | 0 | 0 | 0 | 0 | 0 | 0 | 0 |
| Second particles | Colloidal silica; average particle size of 90 nm | 0.5 | 0.1 | 2 | 0.5 | 0.5 | 0 | 0 | 1 |
| | Titanium dioxide; average particle size of 80 nm | 0 | 0 | 0 | 0 | 0 | 0.5 | 0 | 0 |
| | Resin | 7 | 7 | 7 | 7 | 7 | 7 | 7 | 7 |
| | Wax | 2 | 2 | 2 | 2 | 2 | 2 | 2 | 2 |
| | 2-pyrrolidone | 20 | 20 | 20 | 20 | 20 | 20 | 20 | 20 |
| | Propylene glycol | 5 | 5 | 5 | 5 | 5 | 5 | 5 | 5 |
| | Surfactant | 1 | 1 | 1 | 1 | 1 | 1 | 1 | 1 |
| | Water | Residual | Residual | Residual | Residual | Residual | Residual | Residual | Residual |
| | Total | 100 | 100 | 100 | 100 | 100 | 100 | 100 | 100 |
| B/A mass ratio (%) | | 5 | 1 | 20 | 7 | 3 | 5 | 0 | — |

| | White ink | | | | Processing solution | |
|---|---|---|---|---|---|---|
| Constituents | WH-I | WH-J | WH-K | WH-L | P-A | P-B |
| Aggregating agent A | 0 | 0 | 0 | 0 | 7 | 0 |
| Aggregating agent B | 0 | 0 | 0 | 0 | 0 | 4 |

TABLE 1-continued

| | | | | | | | |
|---|---|---|---|---|---|---|---|
| First Particles | Titanium dioxide; average particle size of 300 nm | 0 | 0 | 0 | 15 | 0 | 0 |
| | Titanium dioxide; average particle size of 210 nm | 10 | 0 | 0 | 0 | 0 | 0 |
| Second particles | Colloidal silica; average particle size of 90 nm | 0.5 | 7 | 0 | 0.5 | 0 | 0 |
| | Titanium dioxide; average particle size of 80 nm | 0 | 0 | 1 | 0 | 0 | 0 |
| | Resin | 7 | 7 | 7 | 7 | 0 | 0 |
| | Wax | 2 | 2 | 2 | 2 | 0 | 0 |
| | 2-pyrrolidone | 20 | 20 | 20 | 10 | 30 | 30 |
| | Propylene glycol | 5 | 5 | 5 | 5 | 5 | 5 |
| | Surfactant | 1 | 1 | 1 | 1 | 1 | 1 |
| | Water | Residual | Residual | Residual | Residual | Residual | Residual |
| | Total | 100 | 100 | 100 | 100 | 100 | 100 |
| B/A mass ratio (%) | | 5 | — | — | 3 | — | — |

The ink materials represented in Table 1 are as follows.
Aggregating agent A: polyvalent metal salt "magnesium sulfate heptahydrate"
Aggregating agent B: cationic polymer "Catiomaster PD-7", polyamine resin (epichlorohydrin-amine derivative resin)
Resin: Styrene acrylic "Joncryl 62"
Wax: Polyethylene-based "AQ515"
Surfactant: Silicon-based "BYK348"
Titanium oxide and colloidal silica (silica particles) were prepared such that the average particle diameters (volume average particle diameters) in the table were obtained by obtaining commercially available titanium oxide pigment and colloidal silica and categorizing them as needed.

The average particle diameters (volume average particle diameter) of the ink constituents shown in Table 1 were volume average particle diameters D50 measured by "Microtrac UPA" (manufactured by Nikkiso Co., Ltd.).

As shown in Tables 2 and 3, the recording was performed by changing combinations of the processing solutions and the ink compositions used in the ink jet recording method and changing various conditions, and various kinds of evaluation were conducted. Hereinafter, conditions of the recording method and details of the respective evaluation tests will be described.

TABLE 2

| Ink | Example 1 WHA | Example 2 WH-B | Example 3 WH-C | Example 4 WH-D | Example 5 WH-E | Example 6 WH-F | Example 7 WH-I | Example 8 WH-L | Example 9 WH-E | Example 10 WH-A | Example 11 WH-A |
|---|---|---|---|---|---|---|---|---|---|---|---|
| Processing solution | — | — | — | — | — | — | — | — | — | — | — |
| Amount of adhering processing solution (with respires to mass of ink) | — | — | — | — | — | — | — | — | — | — | — |
| Maximum time of scanning performed once (sec) | 2.2 | 2.2 | 2.2 | 2.2 | 2.2 | 2.2 | 2.2 | 2.2 | 1 | 2.6 | 3 |
| Width of recording medium (cm) | 160 | 160 | 160 | 160 | 160 | 160 | 160 | 160 | 71 | 198 | 228 |
| Temperature of recording medium during adhesion (° C.) | 35 | 35 | 35 | 35 | 35 | 35 | 35 | 35 | 35 | 35 | 35 |
| Evaluation | | | | | | | | | | | |
| Clogging resistance | A | B | A | A | B | B | A | A | A | B | C |
| White image quality | B | B | B | B | B | A | B | B | A | A | A |
| Whiteness | A | A | A | B | A | A | B | B | A | A | A |
| Shielding properties | A | A | B | B | A | A | B | A | A | A | A |
| Color image quality | C | C | C | C | C | C | C | C | C | C | C |
| Cracking resistance | A | A | A | A | A | A | A | A | A | A | A |

TABLE 2-continued

| | | | | | | | | | | |
|---|---|---|---|---|---|---|---|---|---|---|
| Abrasion resistance | A | A | A | A | B | A | B | B | B | A | A |
| Ink | Example 12 WH-A | Example 13 WH-A | Comparative Example 1 WH-G | Comparative Example 2 WH-G | Comparative Example 3 WH-H | Comparative Example 4 WH-J | Comparative Example 5 WH-K | Reference Example 1 WH-A | Reference Example 2 WH-G | Reference Example 3 WH-A |
| Processing solution | — | — | — | — | — | — | — | — | — | — |
| Amount of adhering processing solution (with respires to mass of ink) | — | — | — | — | — | — | — | — | — | — |
| Maximum time of scanning performed once (sec) | 2.2 | 2.2 | 2.2 | 1 | 2.2 | 2.2 | 2.2 | 0.5 | 0.5 | 2.2 |
| Width of recording medium (cm) | 160 | 160 | 160 | 71 | 160 | 160 | 160 | 36 | 36 | 160 |
| Temperature of recording medium during adhesion (° C.) | 40 | 50 | 35 | 35 | 35 | 35 | 35 | 35 | 35 | 25 |
| Evaluation | | | | | | | | | | |
| Clogging resistance | B | C | D | D | A | B | A | A | B | A |
| White image quality | A | A | B | A | B | B | B | C | C | C |
| Whiteness | A | B | A | A | C | C | C | B | B | B |
| Shielding properties | A | B | A | A | C | B | C | B | B | B |
| Color image quality | C | C | C | C | B | C | B | C | C | C |
| Cracking resistance | A | A | A | A | A | A | A | A | A | A |
| Abrasion resistance | A | A | B | B | A | B | A | A | A | A |

TABLE 3

| Ink | Example 14 WH-A | Example 15 WH-B | Example 16 WH-C | Example 17 WH-D | Example 18 WH-E | Example 19 WH-F | Example 20 WH-I | Example 21 WH-L | Example 22 WH-A | Example 23 WH-A |
|---|---|---|---|---|---|---|---|---|---|---|
| Processing solution | P-A | P-A | P-A | P-A | P-A | P-A | P-A | P-A | P-A | P-A |
| Amount of adhering processing solution (with respires to mass of ink) | 10 | 10 | 10 | 10 | 10 | 10 | 10 | 10 | 20 | 5 |
| Maximum time of scanning performed once (sec) | 2.2 | 2.2 | 2.2 | 2.2 | 2.2 | 2.2 | 2.2 | 2.2 | 2.2 | 2.2 |
| Width of recording medium (cm) | 160 | 160 | 160 | 160 | 160 | 160 | 160 | 160 | 160 | 160 |
| Temperature of recording medium during adhesion (° C.) | 35 | 35 | 35 | 35 | 35 | 35 | 35 | 35 | 35 | 35 |
| Evaluation | | | | | | | | | | |
| Clogging resistance | A | B | A | A | B | B | A | A | A | A |

TABLE 3-continued

| | | | | | | | | | | |
|---|---|---|---|---|---|---|---|---|---|---|
| White image quality | A | A | A | A | A | A | A | A | A | A |
| Whiteness | B | A | A | B | A | A | B | B | B | B |
| Shielding properties | A | A | B | B | A | A | B | A | B | A |
| Color image quality | A | A | B | A | B | A | A | B | A | B |
| Cracking resistance | B | B | A | A | C | C | A | B | C | A |
| Abrasion resistance | B | B | B | B | B | B | B | C | B | A |
| Aggregation viscosity increase rate (times) | 2 | 1.7 | 2.3 | 1.8 | 2.4 | 1.8 | 1.9 | 2.4 | — | — |

| Ink | Example 24 WH-A | Example 25 WH-B | Example 26 WH-B | Comparative Example 6 WH-G | Comparative Example 7 WH-H | Comparative Example 8 WH-J | Comparative Example 9 WH-K | Reference Example 4 WH-A | Reference Example 5 WH-G |
|---|---|---|---|---|---|---|---|---|---|
| Processing solution | P-B | P-A | P-A | P-A | P-A | P-A | P-A | P-A | P-A |
| Amount of adhering processing solution (with respires to mass of ink) | 10 | 10 | 10 | 10 | 10 | 10 | 10 | 10 | 10 |
| Maximum time of scanning performed once (sec) | 2.2 | 2.2 | 1.7 | 2.2 | 2.2 | 2.2 | 2.2 | 2.2 | 2.2 |
| Width of recording medium (cm) | 160 | 160 | 120 | 160 | 160 | 160 | 160 | 160 | 160 |
| Temperature of recording medium during adhesion (° C.) | 35 | 30 | 35 | 35 | 35 | 35 | 35 | 25 | 25 |
| Evaluation | | | | | | | | | |
| Clogging resistance | A | A | A | D | A | B | A | A | C |
| White image quality | A | B | B | A | A | A | A | C | C |
| Whiteness | A | A | A | A | C | C | C | B | B |
| Shielding properties | A | A | A | A | C | B | C | A | A |
| Color image quality | B | B | B | C | A | C | A | B | B |
| Cracking resistance | A | B | B | D | A | D | A | B | D |
| Abrasion resistance | A | B | B | B | A | B | A | B | B |
| Aggregation viscosity increase rate (times) | 1.5 | — | — | 1.9 | 1.2 | 2.2 | 1.3 | — | — |

Recording Test

A modified machine of SC-S40650 manufactured by Seiko Epson Corporation was produced. Three heads were arranged on the upstream side, the downstream side thereof, and the further downstream side thereof of the recording medium in the transport direction. The heads were regarded as a first head, a second head, and a third head from the upstream side. One nozzle array of the first head was filled with the processing solution, one nozzle array of the second head was filled with the white color ink, and one nozzle array of the third head was filled with the non-white ink composition (color ink composition). As the color ink composition, cyan ink that included 3% by mass of Pigment blue 15:3 was prepared instead of the white color pigment and the inorganic oxide fine particles in the composition of "white color ink A". Recording was performed with the white color ink composition on the recording medium. In the examples in which some processing solution was described in Table 3, the white ink was recorded in the overlapping manner after the recording with the processing solution. The color ink composition was further recorded such that the color ink composition overlapped with the white color ink composition in some tests. Note that flashing was performed for all the nozzles with a flashing box next to the platen every time scanning (pass) was performed. A platen heater was provided at a common platen that faced the three heads. Secondary drying was performed with a post-heater (secondary drying furnace) on the downstream side of the head. The platen heater was controlled to adjust the surface temperature of the recording medium in the adhesion process to the values in the table. However, the platen heater was turned off in the example in which the surface temperature was 25° C. The secondary drying was performed at 80° C.

The amounts and density of ink dots were adjusted such that the maximum resolution for each of the processing solution and the ink was set to 1440×1440 dpi and the amounts of adhesion satisfied the following values.

White color ink: 14 mg/inch$^2$

Color ink: 12 mg/inch$^2$

Processing solution: the amounts of adhesion in the table with respect to the total amounts of adhering ink; the amounts of adhesion in the table with respect to the total amounts of adhering white color ink and color ink when the color ink was used.

The number of time scanning was performed was set to eight for each of the processing solution and the ink. That is, the distance of the sub scanning performed once was set to the distance corresponding to one eighth of the length of the nozzle array of one head in the sub scanning direction.

Recording Medium

As the recording medium, LAG jet E-1000ZC (vinyl chloride manufactured by Lintec Corporation) was used. This was cut or pasted such that the width of the recording medium became the values in the table. The time of scanning (pass) performed once was the values in the table depending on the width of the recording medium.

Aggregation Viscosity Increase Rate

The aggregation viscosity increase rates described in the table were scales of the viscosity of the mixture solution after mixing with respect to the viscosity of the ink before the mixing in a case in which the ink and the processing solution were mixed at the mass ratio of 10:1 and were stirred for 1 minute, and the viscosity was measured at 25° C.

The recorded patterns formed on the recording medium after the recording was performed as described above were evaluated. Content of the respective evaluation tests will be described below.

White Image Quality

A test pattern recorded with the white color ink composition was visually evaluated.

A: No density irregularity was observed in a solid plane, and no ink puddle was observed at the rim.

B: Although no density irregularity was observed in the solid plane, ink puddle was slightly observed at the rim.

C: Both density irregularity in the solid plane and ink puddle at the rim were observed.

Whiteness

A test pattern recorded under the same conditions as those for the white image quality was used, and whiteness (L*) of the image was measured by a spectrophotometer Gretag Macbeth Spectrolino (name of product manufactured by X-RITE). A black base sheet with an OD value of 2.1 was used as a base for the measurement.

A: The L* value was equal to or greater than 75.

B: The L* value was equal to or greater than 70 and less than 75.

C: The L* value was less than 70.

Shielding Properties

A test pattern recorded under the same conditions as those for the white image quality was used, and evaluation was performed on the basis of how an appearance of a fluorescent lamp visually looked like when the fluorescent lamp was looked through the test portions.

A: The fluorescent lamp was substantially not observed.

B: The fluorescent lamp was faintly observed.

C: The fluorescent lamp was clearly observed.

Clogging Resistance

Test patterns with a square shape of 3×3 cm were recorded in line in the vertical and horizontal directions over the entire medium under the same conditions as those for the white image quality, and the respective test patterns were recorded at intervals of 3 cm. Recording was successively performed for 2 hours. After the recording, the white nozzle array (360 nozzles) was inspected. Since nozzles that were away from the test patterns were not used during the recording, intermittent printing was performed, and drying of the nozzles advanced. Note that clogging resistance of cyan ink after the cyan ink patterns were recorded using cyan ink under the recording conditions in Example 1 such that the cyan ink patterns overlapped with the white ink patterns and the printing was successively performed for 2 hours in the same manner was evaluated as A.

A: There were no nozzles that did not eject the ink.

B: The proportion of the nozzles that did not eject the ink was equal to or less than 2%.

C: The proportion of the nozzles that did not eject the ink was greater than 2% and equal to or less than 5%.

D: The proportion of the nozzles that did not eject the ink was greater than 5%.

Abrasion Resistance

A test pattern recorded under the same conditions as those for the white image quality was used to evaluate abrasion resistance as follows. However, GIY43R5 (transparent vinyl chloride manufactured by Lintec Corporation) was used as the recording medium. Secondary drying was performed in an environment at 80° C. for 10 minutes.

A: No peeling occurred after rubbing the image ten times under a load of 500 g in the JSPS abrasion resistance test.

B: Although peeling occurred after rubbing the image ten times under a load of 500 g, the proportion of the peeling with respect to the evaluation area was within 10% in the JSPS abrasion resistance test.

C: The proportion of peeling occurring after rubbing the image ten times under a load of 500 g was equal to or greater than 10% in the JSPS abrasion resistance test.

Color Image Quality

A color image was recorded with the color ink composition on the white color image, and the color image was visually observed.

A: No density irregularity was observed in the image.

B: Minute density irregularity was observed in the image.

C: Large density irregularity was observed in the image.

Cracking Resistance

Color images were recorded with the color ink composition on the white color image, and the color images were visually observed. However, the recording with 3 mg/inch$^2$ and 12 mg/inch$^2$ of the color ink was respectively performed, and the color images on the white image were visually observed.

A: There was no cracking in the image formed with 12 mg/inch$^2$ of the color ink. No cracking was found both in the visual observation and observation using a magnifier.

B: Although no cracking was observed in the image formed with 12 mg/inch$^2$ of the color ink in the visual observation while cracking was observed in the observation using a magnifier.

C: Cracking was also observed in the image formed with 12 mg/inch$^2$ of the color ink in the visual observation.

D: Cracking was also observed in the image formed with 3 mg/inch$^2$ of the color ink in the visual observation.

The findings described below were obtained from the results of the examples and the comparative examples.

In all the examples in which the ink was caused to adhere to the heated recording medium using the white color ink that included the first particles and the second particles, and the maximum time of the scanning performed once was equal to or greater than 0.8 seconds, excellent whiteness and excellent clogging resistance were achieved. Meanwhile, in all the comparative examples that did not satisfy the conditions, either the whiteness or the clogging resistance deteriorated. Details will be described below.

In comparison between Examples 12, 13, and 1 and comparison between Examples 25 and 15, a more excellent white image was obtained as the temperature of the recording medium was higher when the ink was caused to adhere while clogging resistance was degraded.

In comparison between Examples 5 and 9, comparison of 10, 11 and 1, and comparison between 26 and 15, clogging resistance tended to be degraded as the maximum time of the scanning performed once was longer while white image quality tended to be enhanced. This was estimated to be because the time before the next scanning was longer as the maximum time of the scanning performed once was longer, drying of the ink advanced, and the white image quality was improved.

In Comparative Examples 1, 2, and 6 in which the ink did not include the second particles, clogging resistance deteriorated.

In Comparative Examples 3 to 5 and 7 to 9 in which the ink did not include the first particles, whiteness deteriorated.

In Reference Examples 1 and 2, the maximum time of the scanning performed once is less than 0.8 seconds, and it was not possible to obtain a recorded product that was useful for display or the like. White image quality also deteriorated, and this is estimated to be because the maximum time of the scanning performed once was short, and the ink was not able to be dried before the next scanning.

In Reference Examples 3 to 5, white image quality deteriorated since the ink was not caused to adhere to the heated recording medium. Note that in Reference Example 5, relatively satisfactory clogging resistance was achieved regardless of the ink that did not include the second particles.

From the viewpoint of the second invention, excellent whiteness, color image quality, and cracking resistance were achieved in all Examples 14 to 26 and Reference Example 4 in which the white color ink including the first particles and the second particles and the processing solution were used from among the examples. Meanwhile, in all Examples 1 to 13 and the comparative examples that did not satisfy the conditions, any of whiteness, color image quality, and cracking resistance deteriorated. Details will be described below.

In comparison of Examples 22, 23 and 14, cracking resistance was further degraded as the amount of the adhering processing solution was larger.

In comparison between Examples 25 and 15, more excellent color image quality was achieved as the temperature of the recording medium when the ink was caused to adhere was higher.

In comparison between Examples 26 and 15, color image quality tended to be improved as the maximum time of the scanning performed once was longer. This is estimated to be because the time before the next scanning was longer as the maximum time of the scanning performed once was longer, drying of the ink advanced, and the color image quality was improved.

In Comparative Examples 6 and Reference Example 5 in which the ink did not include the second particles, clogging resistance deteriorated.

In Comparative Examples 3 to 5 and 7 to 9 in which the ink did not include the first particles, whiteness deteriorated.

In Examples 1 to 13, Comparative Examples 1 and 2, and Reference Examples 1 to 3 in which the processing solution was not used, color image quality deteriorated.

The entire disclosure of Japanese Patent Application No. 2018-058817, filed Mar. 26, 2018 is expressly incorporated by reference herein.

What is claimed is:

1. An ink jet recording method comprising:

heating a recording medium; and ejecting a white color water-based ink composition from an ink jet head to a recording medium heated in the heating of the recording medium and causing the white color water-based ink composition to adhere to the recording medium, wherein the causing of the white color water-based ink composition to adhere is performed by performing scanning, in which the ink composition is ejected while relative positions between the ink jet head and the recording medium are changed in a scanning direction, a plurality of times, and a maximum time of the scanning performed once is equal to or greater than 0.8 seconds, and the white color water-based ink composition contains first particles that are a white color pigment and second particles that are particles of a different kind from the first particles and that are inorganic fine particles.

2. The ink jet recording method according to claim 1, further comprising:

causing a processing solution that includes an aggregating agent for aggregating constituents of the white color water-based ink composition to adhere to the recording medium.

3. The ink jet recording method according to claim 2, wherein an increase rate of viscosity after mixing the white color water-based ink composition with the processing solution is equal to or less than 2.5 times.

4. The ink jet recording method according to claim 2, wherein an adhesion region in which an amount of the adhering processing solution is 5 to 20% by mass with respect to an amount of the adhering white color water-based ink composition is included.

5. The ink jet recording method according to claim 2, wherein the aggregating agent included in the processing solution is one or more kinds of polyvalent metal salts, cationic polymers, and organic acids.

6. The ink jet recording method according to claim 1, wherein a volume average particle diameter of the first particles is equal to or greater than 150 nm, and a volume average particle diameter of the second particles is equal to or less than 100 nm.

7. The ink jet recording method according to claim 1, wherein the first particles are the white color pigment made of an inorganic oxide, and the second particles are particles of an inorganic oxide.

8. The ink jet recording method according to claim 1, wherein 7 to 15% by mass of the first particles are included in the white color water-based ink composition.

9. The ink jet recording method according to claim 1, wherein the white color water-based ink composition includes 1 to 20 parts by mass of the second particles with respect to 100 parts by mass of the first particles.

10. The ink jet recording method according to claim 1, wherein a surface temperature of the recording medium during the causing of the white color water-based ink composition to adhere is from 30 to 45° C.

11. The ink jet recording method according to claim 1, wherein a width of the recording medium in the scanning direction is equal to or greater than 50 cm.

12. The ink jet recording method according to claim 1, wherein transmittance of the second particles is higher than transmittance of the first particles.

* * * * *